US006658676B1

(12) United States Patent
Persson et al.

(10) Patent No.: US 6,658,676 B1
(45) Date of Patent: Dec. 9, 2003

(54) SEMI-PERMANENT BEDSHEET DEVICE

(76) Inventors: Coral Margaret Persson, deceased, late of Tarlee (AU); by Peter Persson, executor, 283 Byfield Rd, Yeppoon QLD 4703 (AU)

( * ) Notice: Subject to any disclaimer, the term of this patent is extended or adjusted under 35 U.S.C. 154(b) by 0 days.

(21) Appl. No.: 10/049,295

(22) PCT Filed: Aug. 11, 2000

(86) PCT No.: PCT/AU00/00955

§ 371 (c)(1),
(2), (4) Date: Feb. 11, 2002

(87) PCT Pub. No.: WO01/12028

PCT Pub. Date: Feb. 22, 2001

(30) Foreign Application Priority Data

Aug. 11, 1999 (AU) ..... PQ5331
Apr. 14, 2000 (AU) ..... 27784/00

(51) Int. Cl.[7] ..... A61G 7/14
(52) U.S. Cl. ..... 5/81.1 HS; 5/89.1; 5/926
(58) Field of Search ..... 5/81.1 R, 81.1 T, 5/81.1 HS, 89.1, 926

(56) References Cited

U.S. PATENT DOCUMENTS 3,829,914 A * 8/1974 Treat ..... 5/81.1 T
3,849,813 A * 11/1974 Neilson ..... 5/495
4,944,053 A * 7/1990 Smith ..... 5/81.1 T
5,155,874 A * 10/1992 Kershaw ..... 5/81.1 T
5,280,657 A * 1/1994 Stagg ..... 5/81.1 R
5,329,655 A * 7/1994 Garner ..... 5/81.1 T
RE35,468 E * 3/1997 Newman ..... 5/81.1 R
5,901,388 A * 5/1999 Cowan ..... 5/81.1 HS
6,012,183 A * 1/2000 Brooke et al. ..... 5/81.1 HS

FOREIGN PATENT DOCUMENTS

| | | |
|---|---|---|
| DE | 195 01 225 | 7/1996 |
| DE | 298 03 192 | 5/1998 |
| GB | 2 294 883 | 5/1996 |
| WO | WO 96/27357 | 9/1996 |
| WO | WO 97/38659 | 10/1997 |

* cited by examiner

*Primary Examiner*—Michael F. Trettel
(74) *Attorney, Agent, or Firm*—Larson & Taylor PLC

(57) ABSTRACT

A bedsheet device (10) configured to overlay a mattress (12), the bedsheet device (10) comprising: a slide sheet (14, 16) being constructed of a pliable material and having a lower surface (14) which is of a relatively low friction material designed to slide relative to an upper surface of the mattress (12) under the weight of a patient; and reinforcing means (20) affixed to the slide sheet (14, 16) to provide sufficient reinforcement to permit suspension and/or turning of the patient upon the slide sheet (14, 16), said reinforcing means (20) being capable of being manipulated independent of the slide sheet (14, 16) to effect said suspension and/or turning of the patient.

8 Claims, 7 Drawing Sheets

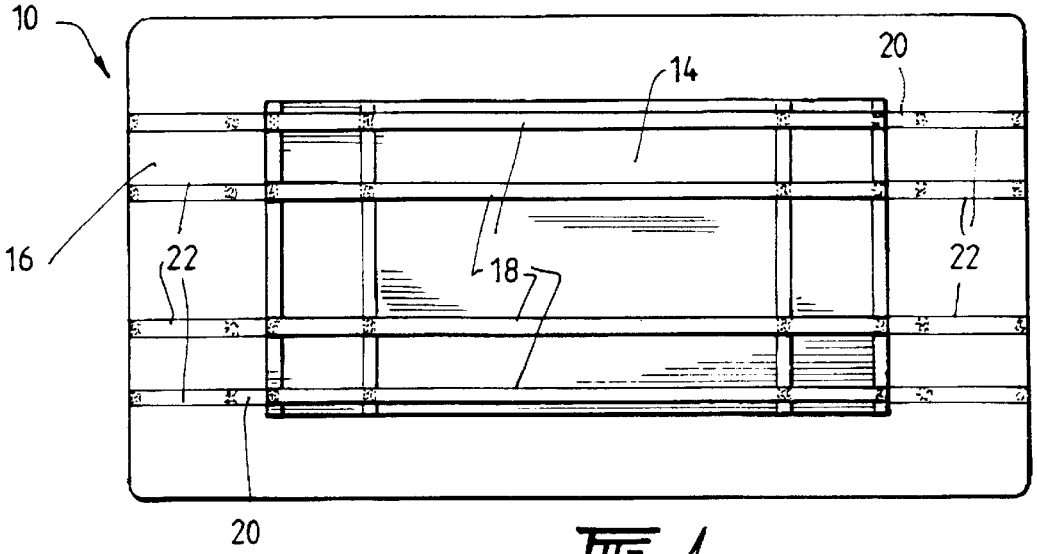
FIG. 1.
FIG. 2.
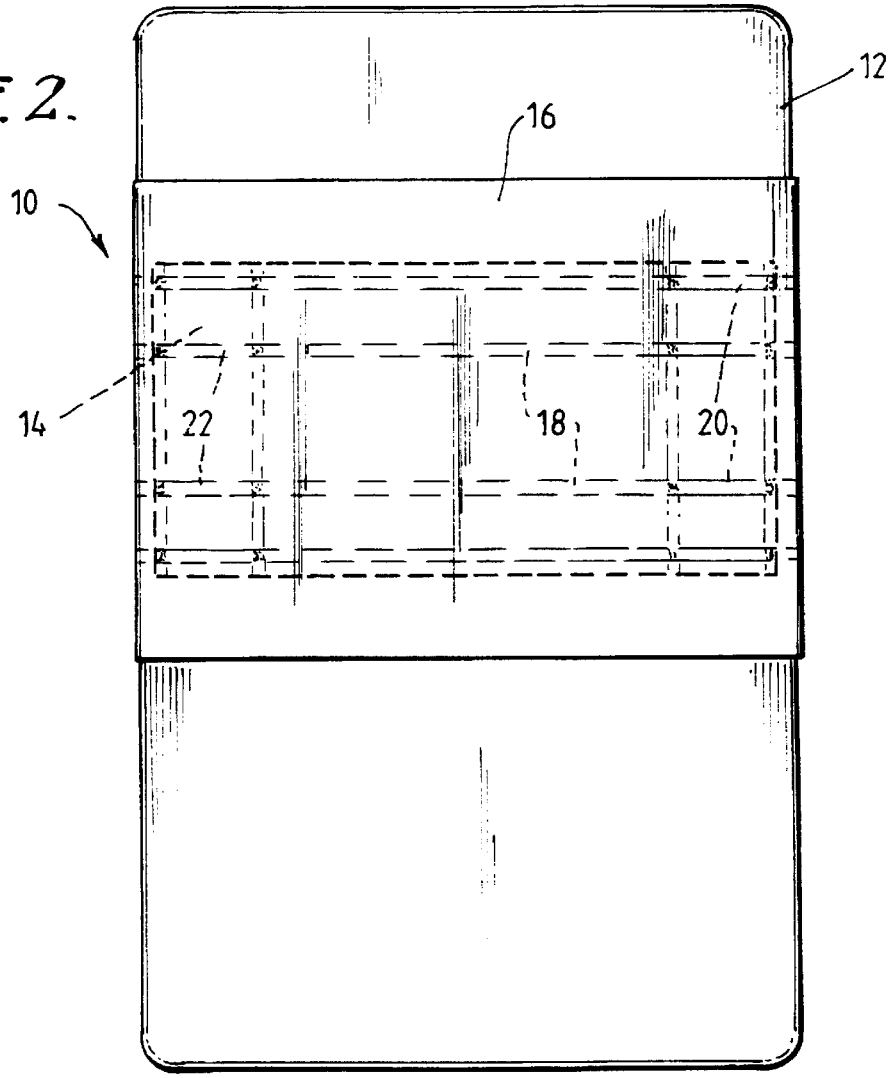

SEMI-PERMANENT BEDSHEET DEVICE

FIELD OF THE INVENTION

The present invention relates generally to a bedsheet device being designed to overlay a mattress and relates particularly, though not exclusively, to a semi-permanent bedsheet device. The invention further relates to a bedsheet device also being appropriate for suspending and/or turning a patient via a mechanical lifting apparatus or the like.

BACKGROUND TO THE INVENTION

There are several "bedslides" or patient transfer sheets described in the patent literature of which U.S. Pat. No. 5,329,655 and Australian patent application No. 49606/96 appear most relevant to the bedsheet device of the present invention. U.S. Pat. No. 5,329,655 discloses a patient sheet having a top surface and a bottom surface to which a low friction material is stitched. In operation, the low friction material is designed to slide across a mattress whilst a patient rests on the top surface of the patient sheet. This allows turning of a patient or transfer of the patient from one bed to another. The "transfer device" of AU 49606/96 includes both an upper sheet having a padded portion and a moisture absorbing layer together with a low friction lower surface, and a lower sheet having a low friction upper surface. The lower sheet is designed to tuck in and under the mattress and the upper sheet is secured to the lower sheet via VELCRO (hook and loop) straps. In use, the VELCRO straps are released to permit sliding of the upper sheet with a patient lying thereon across the lower sheet. Although relatively effective in moving a patient with minimal disturbance, these "bedslides" are somewhat difficult for patient carers and the like to manipulate. In both prior art examples an edge of the patient sheet or the upper sheet itself are grasped by hand and the sheet then drawn across the mattress or the lower sheet.

SUMMARY OF THE INVENTION

According to one aspect of the present invention there is provided a bedsheet device being configured to overlay a mattress, said bedsheet device comprising:

a slide sheet being constructed of a pliable material and having a lower surface which is of a relatively low friction material designed under the weight of a patient to slide relative to an upper surface of the mattress; and reinforcing means affixed to the slide sheet to provide sufficient reinforcement to permit suspension and/or turning of the patient upon the slide sheet, said reinforcing means capable of being manipulated independent of the slide sheet to effect said suspension and/or turning of the patient.

Preferably said reinforcing means includes a plurality of spaced apart reinforcing members each being fixed to the slide sheet to permit transverse or longitudinal sliding of said slide sheet under the load or weight of a patient across the mattress. Generally the reinforcing members are each formed from elongate fabric webbing which is longitudinally stitched to the slide sheet.

According to another aspect of the present invention there is provided a bedsheet device being configured to overlay a mattress, said bedsheet device comprising:

a slide sheet being constructed of a pliable material and having a lower surface which is of a relatively low friction material designed under the weight of a patient to slide relative to an upper surface of the mattress; and a plurality of spaced apart reinforcing members each being affixed to the slide sheet to permit sliding of said sheet under the load or weight of a patient across the mattress, said reinforcing members capable of being manipulated independent of the slide sheet to effect said sliding of the patient.

Preferably the bedsheet device further comprises a cover material affixed to an upper surface of the slide sheet, the cover material providing a resting surface on which the patient may rest and together with the slide sheet being adapted to slidably move relative to the mattress and to overlay the mattress in a resting position wherein the slide sheet is prevented from moving relative to the mattress.

Typically the reinforcing members are also designed to provide lifting locations to which a mechanical lifting apparatus or other lifting means can be connected or coupled for lifting of the bedsheet device together with the patient or turning of the patient.

Preferably said bedsheet device is adapted to retractably receive a stiffening panel which is designed to provide additional support to the patient.

Preferably the bedsheet device may further comprise an undersheet being constructed of another pliable material and having an upper surface which is of a relatively low friction material designed to slidably bear against the lower surface of the slide sheet to enhance sliding movement of said slide sheet relative to the mattress, the undersheet configured to be anchored to the mattress or the slide sheet. More preferably the undersheet is fixed to a bottom sheet which is wrapped about the sides of the mattress thereby anchoring the undersheet to the mattress. Alternatively the undersheet may be secured to the bed via one or more anchoring straps. Generally the undersheet is fabricated of similar materials to the slide sheet such as DACRON fabric or a DACRON/MYLAR laminate.

Preferably the slide sheet is constructed of a pliant fabric, a pliant plastic and fabric laminate, a pliant plastic or a combination thereof. Generally the pliant fabric is a polyester fabric such as that sold under the Dupont trademark of DACRON. The pliant plastic may be a plastic film such as that sold under another Dupont trademark of MYLAR. These materials are typically used in the fabrication of yacht's sails and in particular relatively lightweight material used in the fabrication of spinnakers.

Typically the cover material is at least partly fabricated from a synthetic fabric including a cotton fabric such as calico. Generally the cover material is at least partly constructed of an absorbent fabric. Additionally the cover material may be formed in a pair of opposing synthetic fabric layers with a filler or padding material located therebetween.

Preferably the cover material is stitched to the slide sheet. More preferably said stitching is predominantly arranged transverse to the cover material and thus oriented longitudinally along the mattress with the bedsheet device fitted about the mattress.

Generally the bedsheet device is fitted to the mattress in the resting position via opposing side portions of the slide sheet and/or cover material which are tucked under the mattress. Alternatively or additionally the bedsheet device is draped across the mattress and anchored or fitted via one or more straps secured to a portion of a bed frame.

BRIEF DESCRIPTION OF THE DRAWINGS

In order to achieve a better understanding of the nature of the present invention several preferred embodiments of a bedsheet device will now be described, by way of example only, with reference to the accompanying drawings in which:

FIG. 1 is a plan view of an undersurface of a bedsheet device;

FIG. 2 is a top view of the bedsheet device of FIG. 1 when fitted to a mattress of a bed;

DETAILED DESCRIPTION OF THE PREFERRED EMBODIMENTS

Figure 3:
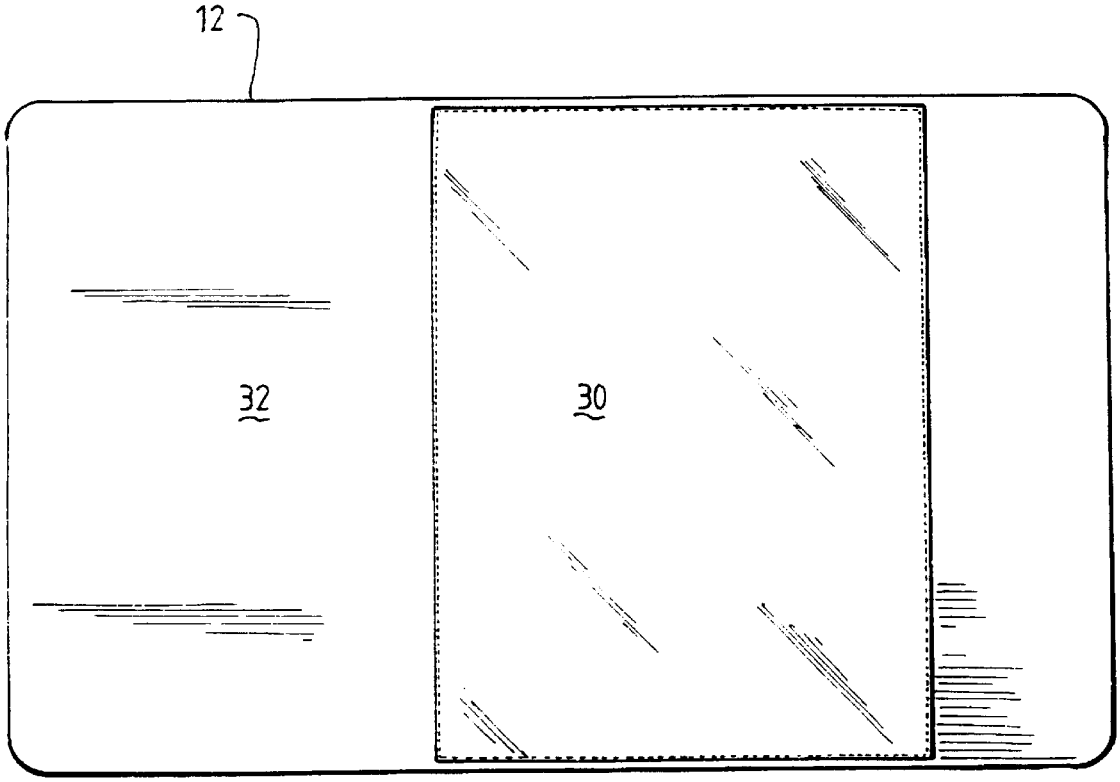
FIG. 3 is a top view of an optional undersheet fitted to the mattress.

As shown in FIGS. 1 and 2 there is a bedsheet device designated generally as 10 being adapted to overlay a mattress 12. The semi-permanent bedsheet device 10 comprises an orthogonal-shaped slide sheet 14 and a cover material 16.

The slide sheet 14 of this embodiment is rectangular and fabricated from a pliable polyester fabric such as that sold in Australia and around the world under the Dupont trade mark of DACRON. The DACRON slide sheet 14 is typically of a weight which is appropriate for the fabrication of a yacht's sails such as relatively lightweight spinnaker cloth.

The rectangular DACRON slide sheet 14 which is depicted with solid outline is stitched to the cover material 16 which is also shaped rectangular. As shown in FIG. 1 the rectangular cover material 16 extends beyond the boundaries of the slide sheet 14. The cover material 16 is in this example fabricated from a synthetic fabric such as calico which advantageously provides an absorbent surface. The cover material 16 may be fabricated from a pair of opposing synthetic fabric layers with a filler or padding material located in between. The filler or padding material is designed for both comfort and to provide an absorbent layer and may be in the form of a doona or include a natural wool fill. An exposed upper surface of the cover material 16 defines a resting surface on which a patient lies. The slide sheet 14 to cover material 16 stitching extends transversely across the slide sheet device 10. Additionally, the cover material 16 may be provided with reinforcing strips 18 which are spaced from one another and extend longitudinally along the cover material 16. Alternatively the cover material 16 may be reinforced by folding the cover material back onto itself and stitching or sewing as a pleat/tuck.

In this particular construction of the bedsheet device 10 there are reinforcing means in the form of a series of strengthening members of webbing such as 20 stitched to both the slide sheet 14 and the cover material 16. The webbing 20 extends longitudinally along the bedsheet device 10 and is aligned with the reinforcing strips 18 of the cover material 16. Importantly, the reinforcing webbing 20 is stitched to the slide sheet 14 and/or the cover material 16 at spaced locations so as to provide grips for manipulation or sliding of the bedsheet device 10 transversely or longitudinally across the mattress. This allows for relatively easy movement of the slide sheet 14 by gripping or otherwise manipulating the reinforcing webbing 20. These grips such as 22 also provide convenient means for fitting or anchoring the bedsheet device 10 in a resting position to a bed or the like.

FIG. 3 illustrates an optional undersheet 30 which may constitute a further component of the bedsheet device 10. The undersheet 30 is in this example constructed of a similar material to the slide sheet 14 such as DACRON. The undersheet 30 is stitched to a conventional bottom sheet 32 which is designed to wrap about the sides of a mattress so as to anchor the undersheet 30 to the mattress. The undersheet 30 is positioned relative to the conventional bottom sheet 32 so that the undersheet 30 aligns with the slide sheet 14. In combination the slide sheet 14 and undersheet 30 provide particularly "slippery" surfaces which permit relatively easy sliding movement of the bedsheet device 10 relative to the mattress 12 under the weight of a patient. However, it should be appreciated that the bedsheet device 10 need not include the undersheet 30 but rather may slide directly upon the mattress 12 or the conventional bottom sheet 32.

Figure 5:
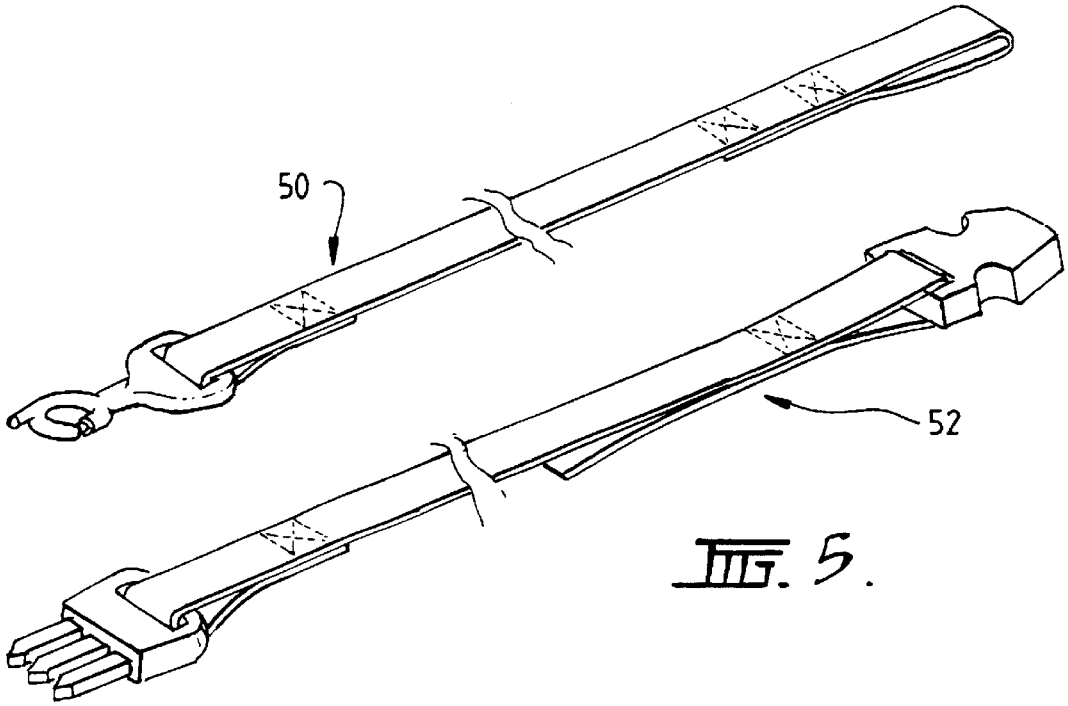
FIG. 5 is a schematic illustration of the bedsheet device fitted to a mattress together with the accessory items.
Figure 4:
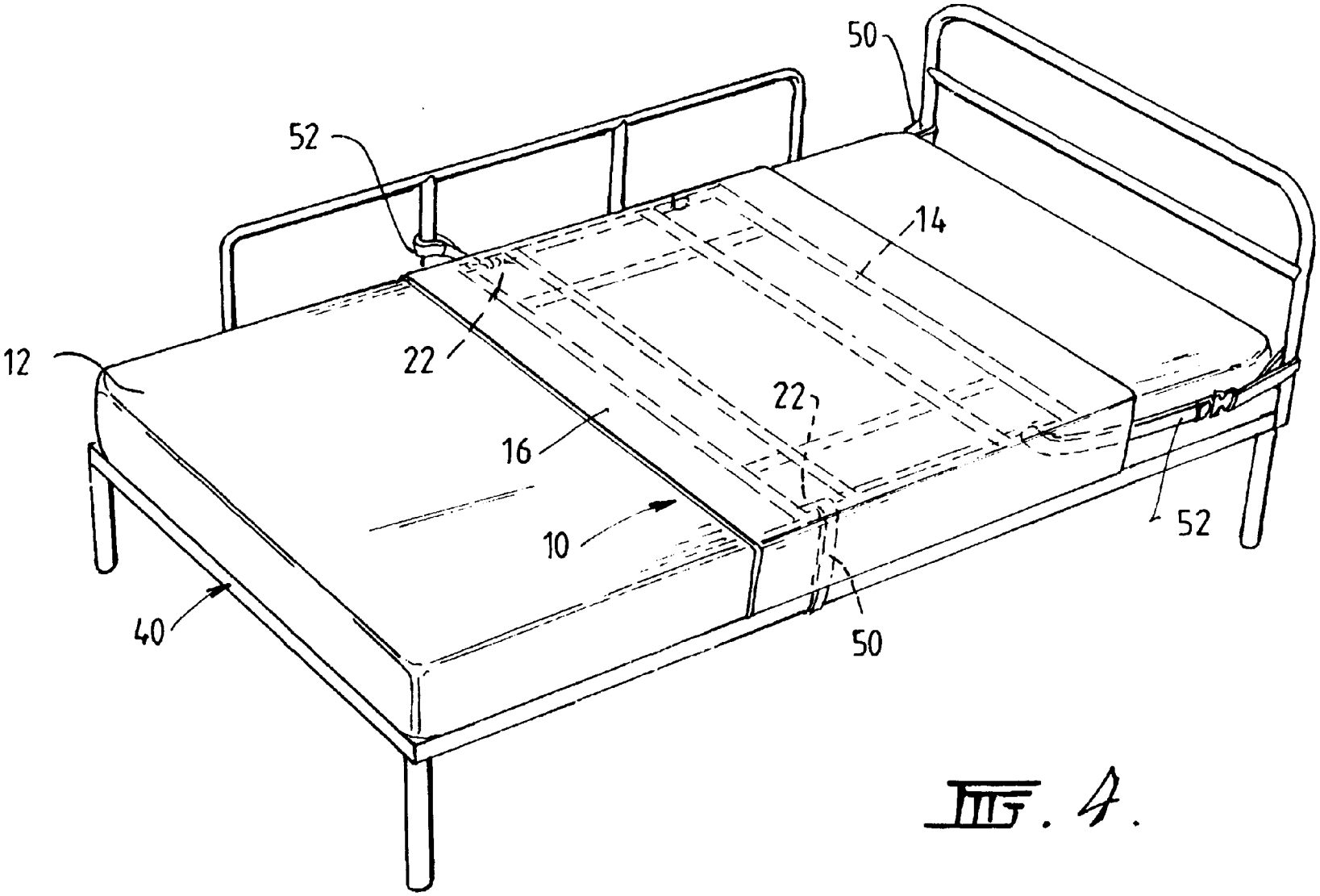
FIG. 4 illustrates various accessory items to the bedsheet device.

FIGS. 4 and 5 depict the bedsheet device 10 in a resting position fitted to the mattress 12 of a bed 40 together with accessory straps such as 50 and 52. In this example the bed is in the form of a bed trolley 40 of a conventional construction with side rails and barriers. The accessory straps 50 and 52 as shown in detail in FIG. 5 are configured to loop through one of the grips such as 22 of the bedsheet device 10 and clip back onto itself. The accessory strap 50 or 52 is wrapped about a rigid portion of the bed trolley 40 such as the bedhead or side rail so as to restrict inadvertent sliding of the bedsheet device 10 relative to the mattress 12. The accessory straps 50 or 52 may be adjustable and as illustrated are of a conventional construction having either a clamp and loop or mutually engagable clips at respective opposing ends.

Figure 6:
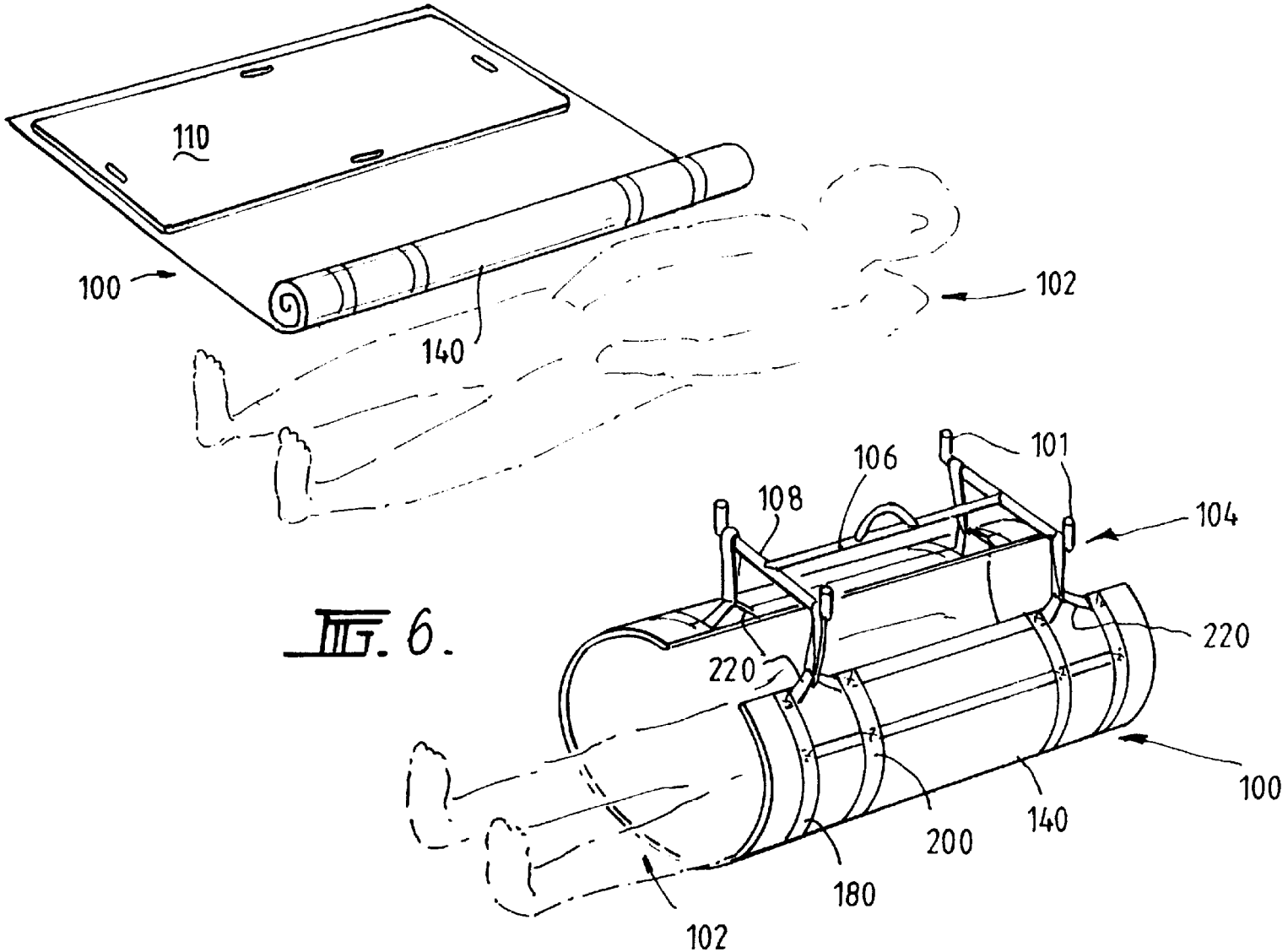
FIG. 6 schematically depicts another bedsheet device in conjunction with a mechanical lifter.

FIG. 6 schematically illustrates another embodiment of the invention in the form of a bedsheet device designated generally as 100 being designed for lifting a patient 102. The bedsheet device 100 is similar in construction to the bedsheet device 10 described above. For ease of reference and to avoid repetition similar components have been designated with an additional "0". For example, the slide sheet of this bedsheet device 100 has been designated as 140.

The bedsheet device 100 in its basic form may not include a cover material such as that present in-the preceding bedsheet device 10. The bedsheet device 100 is designed to be lifted in conjunction with the patient 102 via a mechanical lifting apparatus such as 104. The lifting apparatus 104 in this embodiment includes a lifting frame or hanger 106 to which the sling device 100 is coupled. A rigid lifting arm such as 108 engages adjacent grips such as 220 of adjacent strengthening members 200 which are formed of relatively strong webbing. The lifting arms 108 may be incorporated in the sling device 100 or provided as components of the mechanical lifting apparatus 104.

Alternatively the loops 101 provided at each corner of the lifting apparatus 104 engage the grips 220 themselves.

In operation the bedsheet device 100 which is fabricated from the pliable DACRON material is at least partially rolled and then slid under the patient 102. The rolled portion of the sling device 100 can then be unrolled and the sling device 100 coupled to the mechanical lifting device 104 as shown in FIG. 6. If additional support is required for the patient the relatively "slippery" surface of the DACRON slide sheet 140 may be slid under a firm yet pliable slide 110. This is particularly advantageous where the patient has suspected bone fractures or the like. The applicant also intends the bedsheet device 100 to be lifted "hands-free" with a sling arrangement (not shown) which is worn by a carer. The sling is worn over the carer's shoulders and crosses over their chest. The sling couples to the bedsheet device itself or a bar or lifting rod which is inserted in the device 100.

It should be appreciated that the bedsheet device 100 may be fabricated in the same fashion as the preceding bedsheet device 10. In this instance the bedsheet device 10/100 serves the dual purpose of allowing movement of the patient across a bed whilst also permitting lifting of the patient clear of the bed. Thus, the bedsheet device 10/100 permits relatively easy movement of the patient whilst also being capable of remaining in-situ on the bed or mattress so that it is semi-permanent.

Figure 7:
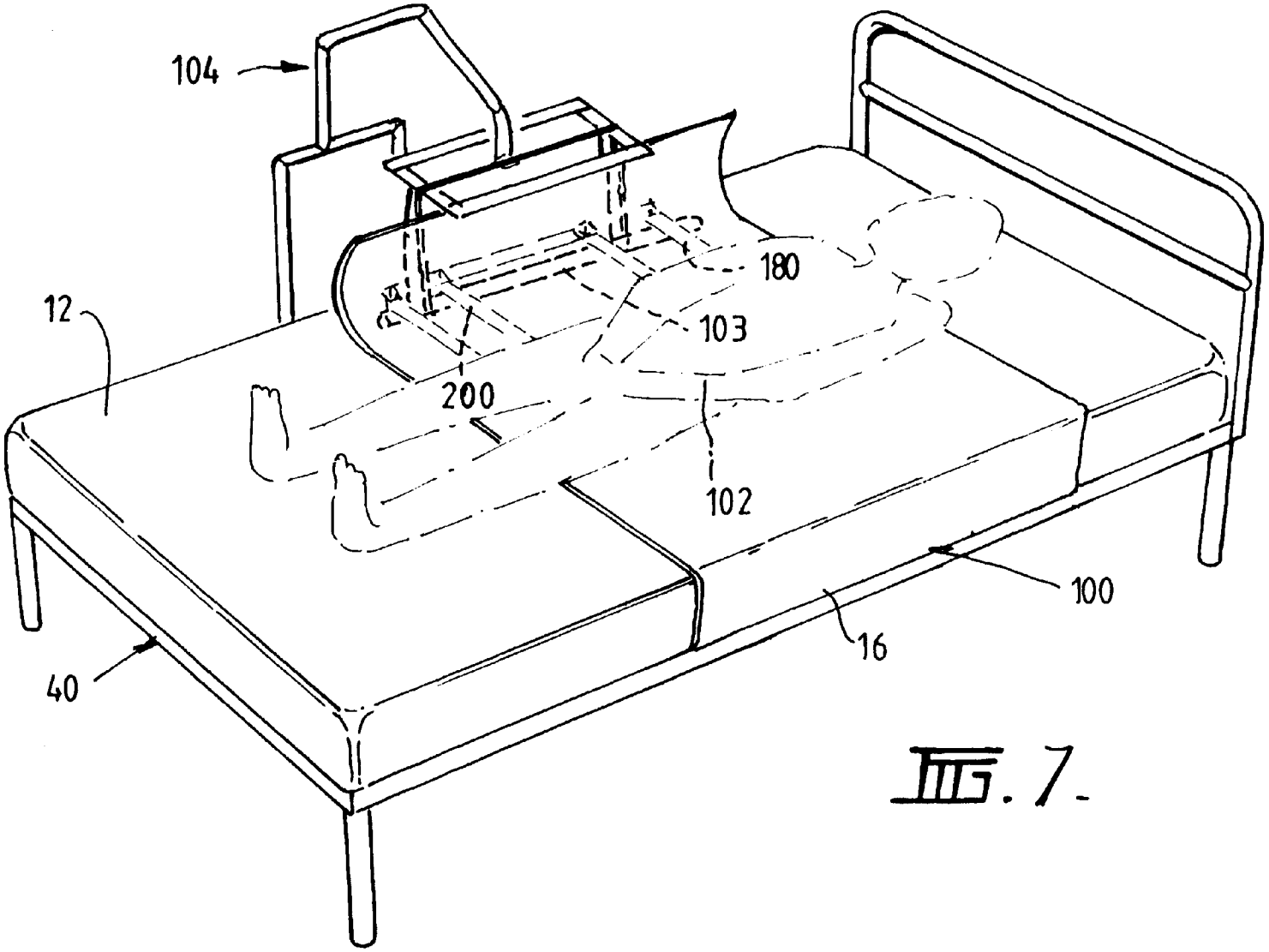
FIG. 7 is a schematic illustration of a further bedsheet device in conjunction with a mechanical lifter.

FIG. 7 illustrates another embodiment of the bedsheet device shown as 100 in conjunction with a mechanical lifting apparatus shown generally a 104. In this embodiment a lifting bar such as 103 is slid between opposing strengthening members such as 180 and 200. The mechanical lifting apparatus 104 engages the bar 101 to effect movement of the bedsheet device 100 for lifting or rolling of the patient.

Figure 8:
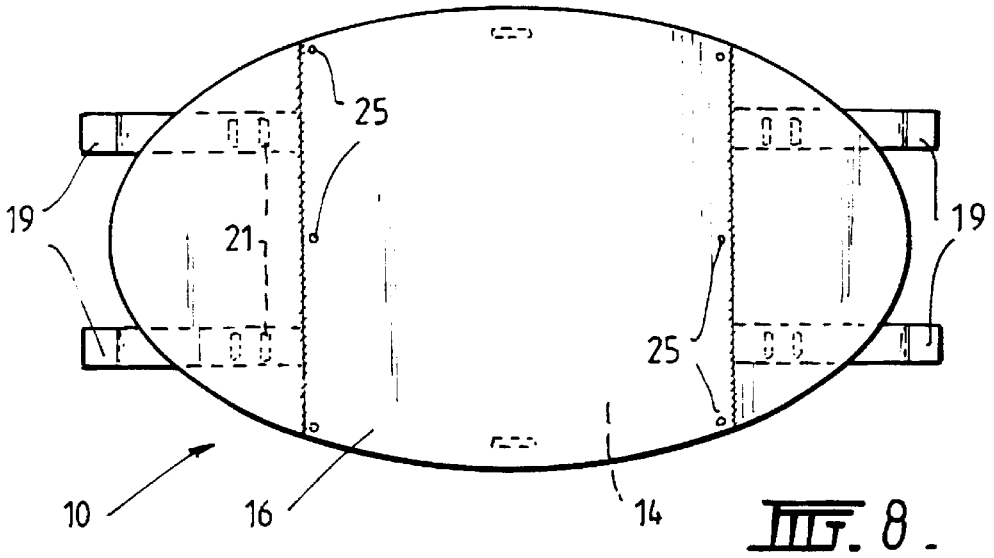
FIG. 8 is a plan view of an upper surface of yet another bedsheet device.
Figure 9:
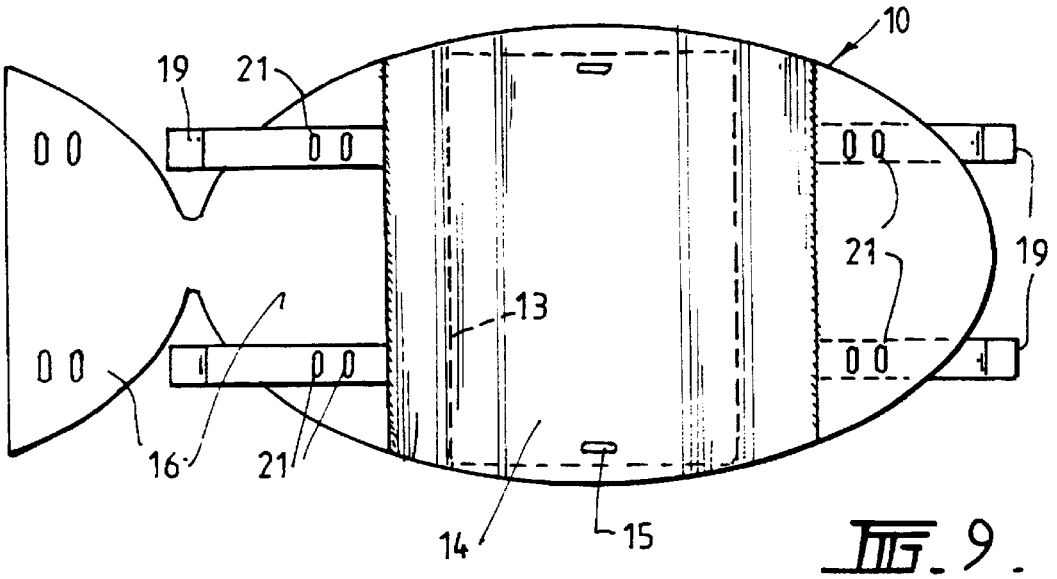
FIG. 9 is a plan view of an undersurface of the bedsheet device of FIG. 8.

FIGS. 8 and/or 9 are plan views of an upper and a lower surface, respectively, of a further embodiment of a bedsheet device shown generally as 10. For ease of reference and in order to avoid repetition, similar features of this bedsheet device have been designated with the same reference numerals as the first described embodiment of the invention. In this example the cover material 16 is shaped generally elliptical rather than rectangular. The slide sheet 14 is shaped substantially identical to the cover sheet 16 but with its opposing ends truncated. The slide sheet 14 is stitched to the cover material 16. A cavity shown as hidden detail in FIG. 9 is provided between the slide sheet 14 and the cover material 16. A stiffening panel 15 is inserted in the cavity 13 between the slide sheet 14 and the cover material 16. The stiffening panel is preferably constructed of a plastics sheet which may be in the form of a fiberglass stiffening panel. This provides additional support to a patient resting on the bedsheet device 10.

Figure 10:
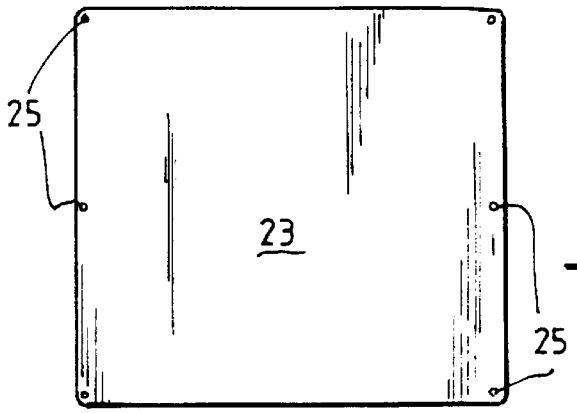
FIG. 10 is a plan view of an optional waterproof sheet to be fitted to the upper surface of the bedsheet device.

FIGS. 8 and 9 depict two embodiments of extended grips such as 19 which are stitched to the slide sheet 14 and/or the cover material 16, the extended grips 19 allowing for relatively easy manipulation or sliding of the bedsheet device 10. Alternatively, the extended grips 19 are designed to receive pole or bar inserts such as 103 depicted in FIG. 7. Additionally or alternatively, the grips such as 19 may include slots such as 21 which a carer can grab to effect relatively easy manipulation of the bedsheet device 10. In these embodiments the extended grips or hand holes such as 19 or 21, respectively, constitute reinforcing means. Furthermore, the cover material 16 is at opposing ends folded back onto itself to provide additional strength to the bedsheet device 10. FIG. 10 illustrates a waterproof sheet 23 which is designed to attach to an upper surface of the cover material 16. In this example press studs such as 25 are included on the waterproof sheet 23 and the cover material 16 for affixture of the waterproof sheet 23. Otherwise, the cover material 16 is designed to tuck in and under a mattress as described above. The bedsheet device 10 may be located directly on the mattress or alternatively placed over the optional undersheet 30 described earlier.

Figure 11:
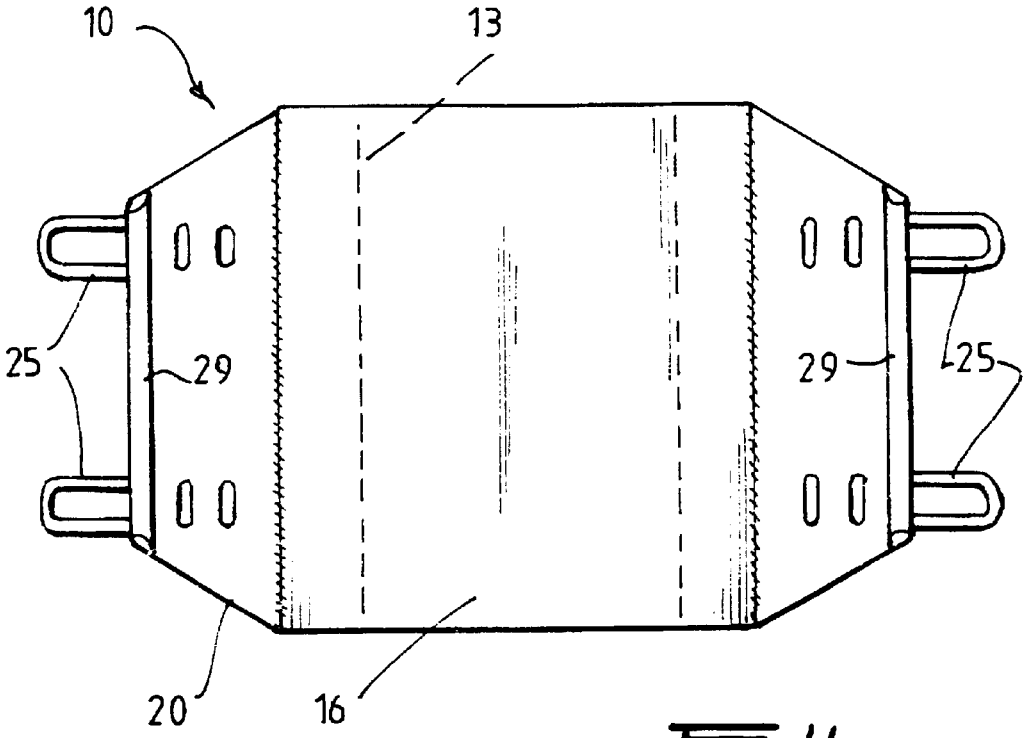
FIG. 11 is a plan view of yet another bedsheet device.
Figure 12:
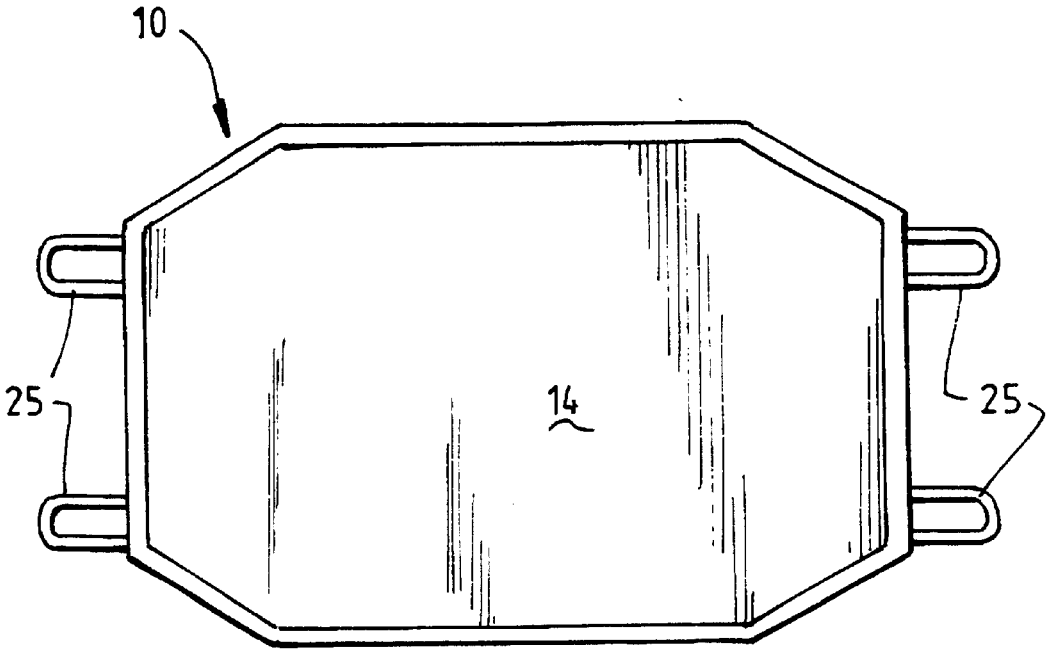
FIG. 12 is a plan view of an undersurface of yet a further bedsheet device.

FIGS. 11 and 12 depict two (2) further embodiments of the bedsheet device 10. Once again, like components have been designated with the same reference numerals. The bedsheet device of FIG. 11 is shaped generally rectangular with its corners truncated. In both examples the bedsheet device 10 is fabricated from a high strength cellulose material. No reinforcing webs are provided but rather overlapping of end portions of the bedsheet device 10 provide adequate strength for manipulation of the bedsheet device 10. Additionally, handles or grips such as 25 may be provided on opposing ends of the bedsheet device 10. In this example the upper and lower surfaces of the cellulose material itself serve as the cover material and the slide sheet, respectively. Additionally, opposing ends of the bedsheet device 10 may be formed as a tube such as 29 so as to receive a lifting bar such as 103.

Now that several preferred embodiment of the invention have been described in some detail it will be apparent to those skilled in the art that the bedsheet device has at least the following advantages:

(i) the device permits relatively easy movement of patients with minimal disturbance to the patient;

(ii) the device allows carers or resource personnel to move patients with minimal physical effort;

(iii) the device can remain in place after use and thus forms a semi-permanent fixture on the bed; and (iv) the bedsheet device is relatively simple and safe to use.

Those skilled in the art will appreciate that the invention described herein is susceptible to variations and modifications other than those specifically described. For example, the slide sheet may be constructed of practically any pliable material which permits sliding of a patient relative to another surface such as a mattress or floor. The specific constructional features of the bedsheet device and the sling device may vary provided they function as broadly defined in the specification. According to other embodiments of the invention the bedsheet device may comprise:

(i) a slide sheet alone together with one or more grips provided in one embodiment by webbing stitched to the slide sheet to permit sliding of the bedsheet device together with a patient lying thereon across the bed; or (ii) a slide sheet and an underslide sheet which is designed to secure to the bed, the slide sheet capable of being dragged or slid across the underslide sheet under the weight of a patient.

If the bedsheet device does not include a cover material, a comfortable and prefererably absorbent layer of bedding may be located between the patient and the slide sheet. If the slide sheet itself is not waterproof a waterproof drawsheet may also be placed on top of or underneath the slide sheet to prevent soiling of the mattress.

All such variations and modifications are to be considered within the scope of the present invention the nature of which is to be determined from the foregoing description.

The claims defining the invention are as follows:

1. A bedsheet device being configured to overlay a mattress, said bedsheet device comprising:

a slide sheet being constructed of a pliable material and having a lower surface which is of a relatively low friction material designed under a load or weight of a patient to slide relative to an upper surface of the mattress; and a plurality of spaced apart reinforcing members each being affixed and extending longitudinally along the upper surface of the slide sheet, and being spaced at a distance from an edge of the slide sheet to permit sliding of said sheet under the load or weight of the patient across the mattress, said reinforcing members capable of being manipulated independent of the slide sheet to effect said sliding, turning and/or suspension of the patient.

2. A bedsheet device as defined in claim 1 further comprising a cover material affixed to the upper surface of the slide sheet, the cover material providing a resting surface on which the patient may rest and together with the slide sheet being adapted to slidably move relative to the mattress and to overlay the mattress in a resting position wherein the slide sheet is prevented from moving relative to the mattress.

3. A bedsheet device as defined in claim 2 wherein the cover material is at least partly fabricated from a synthetic fabric including a cotton fabric.

4. A bedsheet device as defined in claim 3 wherein the cover material is stitched to the slide sheet.

5. A bedsheet device as defined in claim 1 wherein the reinforcing members are also designed to provide lifting locations to which a mechanical lifting apparatus or other lifting means can be connected or coupled for lifting of the bedsheet device together with the patient or turning of the patient.

6. A bedsheet device as defined in claim 1, said device being adapted to retractably receive a stiffening panel which is designed to provide additional support to the patient.

7. A bedsheet device as defined in claim 1 further comprising an undersheet being constructed of another pliable material and having an upper surface which is of a relatively low friction material designed to slidably bear against the lower surface of the slide sheet to enhance sliding movement of said slide sheet relative to the mattress, the undersheet being configured to be anchored to the mattress or the slide sheet.

8. A bedsheet device as defined in claim 1 wherein the slide sheet is constructed of a pliant fabric, a pliant plastic and fabric laminate, a pliant plastic or a combination thereof.

* * * * *